US010181686B1

(12) United States Patent
Patel et al.

(10) Patent No.: US 10,181,686 B1
(45) Date of Patent: Jan. 15, 2019

(54) ILLUMINATED USB TYPE C POWER ADAPTER

(71) Applicant: Xentris Wireless LLC, Addison, IL (US)

(72) Inventors: Vivek Patel, Elk Grove Village, IL (US); Terrell Morrow, Elgin, IL (US); Christopher Whetstone, Aurora, IL (US); Mark William Lopotko, Carol Stream, IL (US)

(73) Assignee: XENTRIS WIRELESS, LLC, Addison, IL (US)

( * ) Notice: Subject to any disclaimer, the term of this patent is extended or adjusted under 35 U.S.C. 154(b) by 23 days.

(21) Appl. No.: 15/877,341

(22) Filed: Jan. 22, 2018

(51) Int. Cl.
*H01R 13/717* (2006.01)
*H01R 31/06* (2006.01)
*H01R 13/703* (2006.01)

(52) U.S. Cl.
CPC ..... *H01R 13/7175* (2013.01); *H01R 13/7036* (2013.01); *H01R 31/065* (2013.01)

(58) Field of Classification Search
CPC ..... H01R 13/7175
USPC ..... 439/620.21
See application file for complete search history.

(56) References Cited

U.S. PATENT DOCUMENTS

| | | | | |
|---|---|---|---|---|
| 8,740,640 | B2 * | 6/2014 | Hardy | H01R 13/7175 439/490 |
| 9,690,955 | B2 * | 6/2017 | Waters | G06F 1/26 |
| 2014/0140076 | A1 * | 5/2014 | Morrow | H01R 13/6641 362/382 |
| 2015/0032918 | A1 * | 1/2015 | Zhang | G06F 13/102 710/62 |
| 2017/0005447 | A1 * | 1/2017 | Kim | H01R 13/6616 |
| 2017/0005190 | A1 | 2/2017 | Rodriguez et al. | |
| 2017/0133792 | A1 | 5/2017 | Werly et al. | |
| 2017/0133800 | A1 | 5/2017 | Wu et al. | |
| 2017/0194756 | A1 * | 7/2017 | Chang | H01R 13/646 |

* cited by examiner

*Primary Examiner* — Abdullah Riyami
*Assistant Examiner* — Nader Alhawamdeh
(74) *Attorney, Agent, or Firm* — Babcock IP, PLLC

(57) ABSTRACT

An illuminated interface cable with a USB type C connector interface on at least one end. A light circuit including a light and a mechanical switch, the light circuit powered by a power level negotiation CC conductor of the cable to energize the light upon actuation of the mechanical switch. The light and switch coupled to the connector interface, the light oriented to illuminate an interconnection area of the connector interface. The light may be provided, for example, as a light emitting diode.

19 Claims, 5 Drawing Sheets

| A1 | A2 | A3 | A4 | A5 | A6 | A7 | A8 | A9 | A10 | A11 | A12 |
|---|---|---|---|---|---|---|---|---|---|---|---|
| GND | TX1+ | TX1- | VBUS | CC1 | D+ | D- | SBU1 | VBUS | RX2- | RX2+ | GND |
| GND | RX1+ | RX1- | VBUS | SBU2 | D- | D+ | CC2 | VBUS | TX2- | TX2+ | GND |
| B12 | B11 | B10 | B9 | B8 | B7 | B6 | B5 | B4 | B3 | B2 | B1 |

ILLUMINATED USB TYPE C POWER ADAPTER

BACKGROUND

Field of the Invention

This invention relates to power and/or data cables for electronic apparatus. More particularly, the invention relates to a power and/or data cable for electronic apparatus with an illuminated Universal Serial Bus Type C (USB-C) interconnection interface.

Description of Related Art

Electronic apparatus, particularly portable electronic devices such as cellular telephones, laptops and/or tablet computers utilize cables for power, charging and/or data exchange.

Electronic devices may require interconnection with the cable, for example for charging as a part of daily routine, often performed for example by the user's bedside so that the device recharges overnight, while still available for use even while charging.

A problem with prior cables is that interconnecting the male cable connector interface to the electronic device female interface may be difficult as the interfaces are small and require relatively precise alignment prior to interconnection. It may be particularly difficult to align for interconnection in poor lighting conditions and/or darkness as the female electronic device interface may be a recessed socket preventing alignment by touch.

Illuminated cables, wherein the cable illuminates to indicate an energized status are known. However, a constantly illuminated cable may waste power and/or create undesirable illumination, for example in places/times where darkness may be preferred, such as a bedroom when another person is sleeping.

Application publication US2014/0140076 by Morrow et al. discloses an illuminated interface cable with a switch activated light emitting diode (LED) configured to illuminate the connection interface area upon activation of a switch provided on the connector body. The LED is powered via the Vbus conductor of the USB 2.0 connection interface. According to the USB 2.0 specification, the Vbus conductor is energized at all times.

An emerging industry standard for interface/interconnection for many electronic devices is the USB-C interface. A USB-C interface provides both power and data interconnections in a very small space, reducing the mating connector dimensions required on the electronic device and thereby enabling electronic devices that are smaller and therefore have increased portability. Unlike previous USB connection interface standards, the USB-C interface is reversible and capable of delivering device specified power levels. For example, connected electronic devices may specify a high power level to enable quick charge protocols.

To ensure that an electronic device coupled to a charger via USB-C is not provided with a higher power level than it is configured for, the USB-C interface provides data lines for negotiation of the appropriate power level between the power source (smart charger) and the electronic device, before the Vbus conductors are energized.

Convenience, cost and/or reliability may be significant factors of commercial success in the consumer electronic market.

Therefore, an object of the invention is to provide a cable that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that a cable with a USB-C connection interface cannot utilize the Vbus conductor previously relied upon to energize an interconnection area illuminating LED to guide interconnection in dark environments, because the USB-C connection interface specifies that the Vbus conductor is not energized until the connection interface has already been interconnected and data negotiation to identify the correct power level for the connected electronic device has been completed across the interconnection. That is, according to the USB-C specification, the Vbus conductor is unpowered until the interconnection operation desired to be illuminated has already been completed, so a conventional illuminated connection interface is inoperable where the connection interface is USB-C.

Details of the USB-C Technical Specification "Universal Serial Bus Revision 3.2", hereby incorporated by reference in the entirety, may be found via the USB Implementers Forum, Inc. of Beaverton, Oreg. (www.USB.org).

Figure 8:
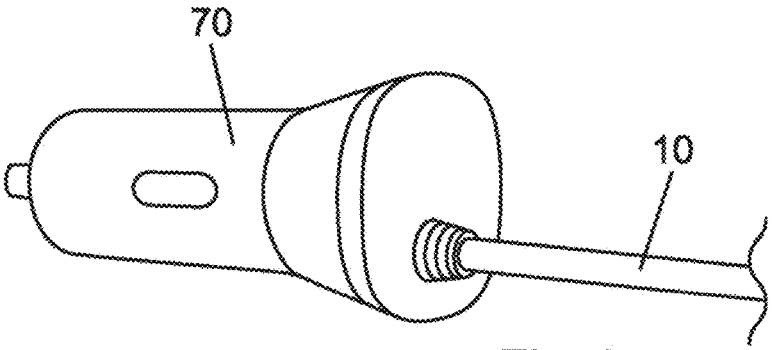
FIG. 8 is a schematic isometric view of a car adapter connection interface.
Figure 9:
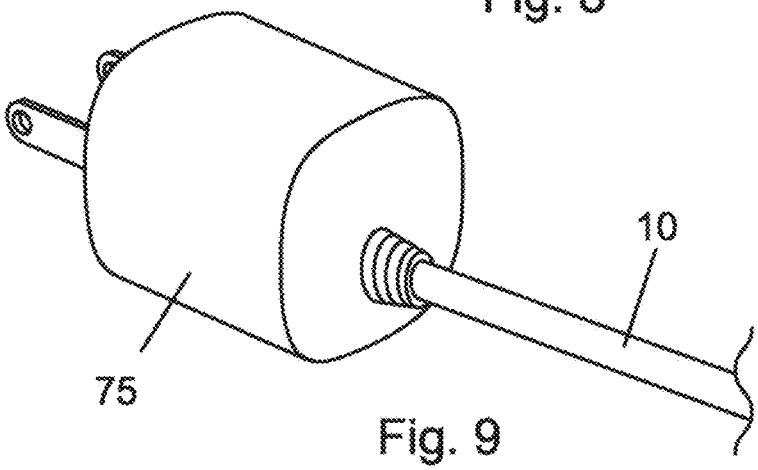
FIG. 9 is a schematic isometric view of a wall adapter connection interface.
Figure 10:
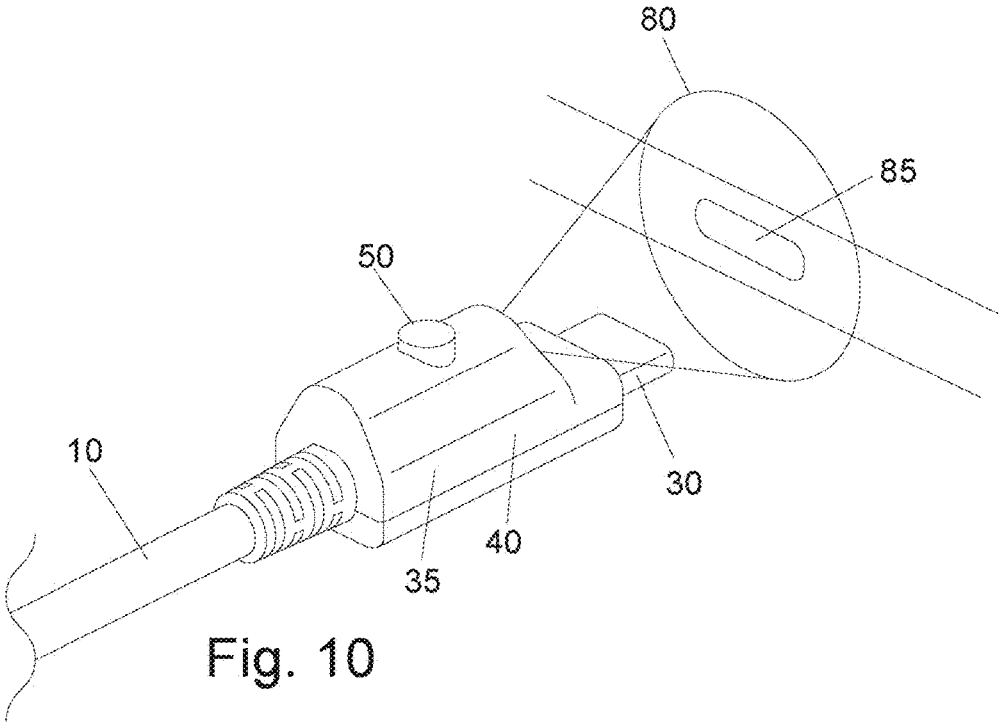
FIG. 10 is a schematic isometric view of a connection interface with a light for illuminating the connection area, demonstrating selective illumination of the connection area for ease of interconnection with minimized light pollution.

As demonstrated in FIGS. 1-10, an illuminated interface cable 10 is provided with a switch 15 that activates a light 20 illuminating the interface area 80 for ease of interconnection, with minimal light pollution outside of the interface area 80. The interface area 80 may be defined as the area into which the interface is inserted to interconnect two interfaces with one another. The illuminated interface cable 10 enables, for example, illumination sufficient to guide interconnection with a corresponding interface 85 of, for example, electronic devices in a dark area without disturbing the overall light levels of the dark area, such as a bedroom at night, for example as shown in FIG. 10.

Figure 1:
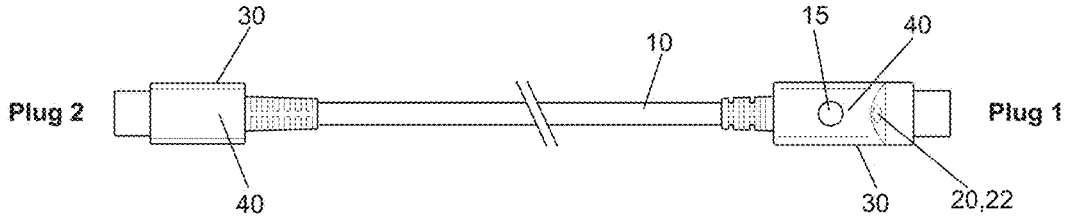
FIG. 1 is a schematic representation of an exemplary illuminated interface cable with USB-C connector interfaces.

The cable 10 may be a standard USB-C interface cable, for example demonstrated in FIG. 1 as a shielded multi-conductor data/power cable 10 with an illuminated standard USB-C interface 30 at a first end, Plug 1, and a USB-C interface 30 at a second end, Plug 2.

Figures 2, 3:
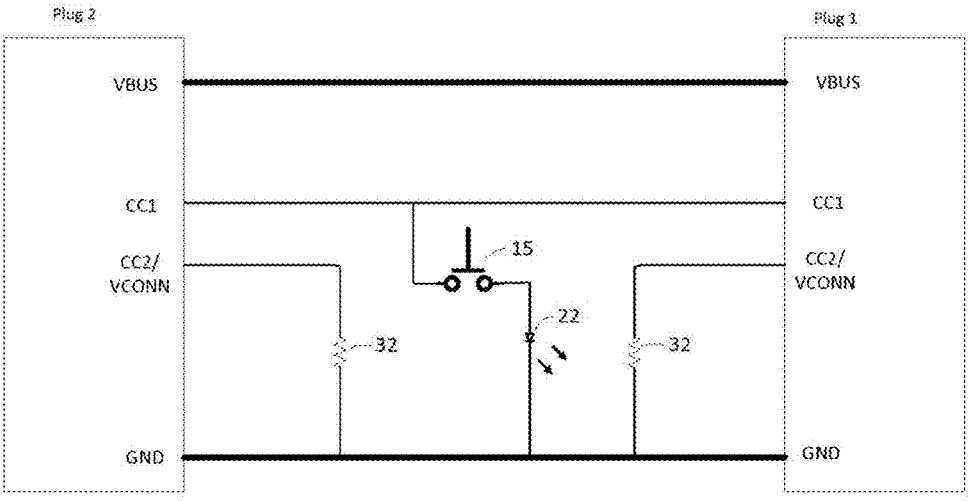
FIG. 2 is a schematic circuit diagram for the pins of a USB-C connector.
FIG. 3 is a schematic circuit diagram for an illuminated interface cable wherein the light is an LED activated by a switch.

As shown in FIG. 2, the USB-C connection interface includes up to 24 pins (12 pins each side), including a CC (configuration channel) pin (CC1 one on a first side and CC2 on a second side). The CC pins are utilized by the USB-C connection interface for orientation determination, negotiation of the power level to be delivered at the Vbus and/or identification of an audio mode (signifying headphones are attached—not relevant for power delivery modes). Via the CC pins, a power adapter and electronic device interconnected via a USB-C cable 10 can negotiate a dynamic power level depending upon the current needs of the electronic device.

The CC1 and CC2 pins of a USB-C power adapter are internally connected to either 3.3V or 5V via a pull up resistor according to the USB-C power delivery specification. Exemplary connections internal to the cable 10 are shown in FIG. 3. When one end of the USB-C cable is plugged into the USB type C power adapter, the switch 15 connected to CC1 on the USB-C cable will be pulled HIGH to the 3.3V or 5V supply from the USB-C power adapter. A light 20, such as a shunt Light Emitting Diode (LED) 22 is connected in series between the other end of the switch 15 and ground. Thereby, the negotiation signal levels of the CC pin may be utilized as an always available source of power sufficient to illuminate an LED 22 upon activation of a switch 15 present in the connection interface at Plug 1. Where CC1 is used for the switch 15 and LED 22 circuit, CC2 may be pulled down by application of a pull down resistor 32, such as 1K ohm, coupled to ground at each of the first end and the second end (at Plug 1 and Plug 2, respectively).

When the user activates the switch 15, for example pressing a spring surface, the closed switch will form a circuit allowing current to flow through it and turn ON (light up) the LED 22. When the user de-activates the switch (releases the spring surface) it will become an open circuit and no current will flow through the switch and the LED 22 will be turned OFF.

When a USB-C electronic device is connected to a USB-C power adapter with the USB-C to USB-C cable with user activated LED 22, there is no change in the normal operation of charging the electronic device. With respect to data-transfer modes, such as when a USB-C electronic device is connected to a USB-C laptop/computer with the USB-C to USB-C cable with user activated LED 22, there is no change in the normal operation of charging the electronic device and/or enumerating the electronic device for file transfers between the electronic device and laptop/computer.

The light 20, such as a light emitting diode (LED) 22, may be provided, for example, at the USB-C interface 30 end P2, the light 20 preferably directed primarily upon the direction of insertion for the mating USB-C connector. The light 20 may be encapsulated into the overbody 35 of the connector, for example applied within the polymeric overbody 35 of the connector hand grip surface 40. By recessing the LED 22 within an aperture 45 of the surrounding overbody 35 open to the interconnection end, the light output may be guided toward the desired interface area 80, minimizing light pollution outside of the interface area 80 (see FIG. 10).

Figure 4:
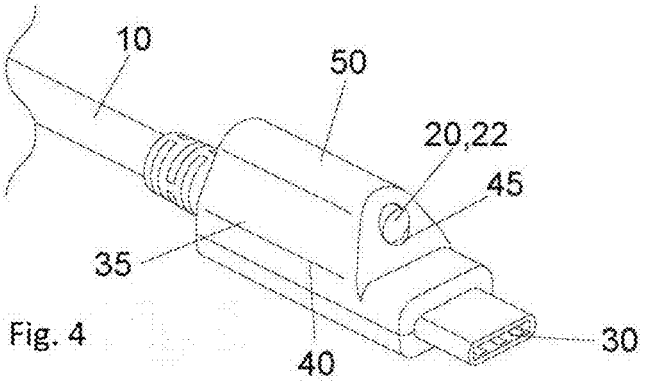
FIG. 4 is a schematic isometric view of a connection interface with a light for illuminating the connection area, the light and momentary switch to activate the light enclosed within an overbody of the connector.

Any of several embodiments of the switch 15 may be applied, for example as shown in detail in FIGS. 4-7. FIG. 4 demonstrates a connector overbody 35 wherein the switch 15 is a momentary-type switch, enclosed within the connector overbody 35, activated by squeezing a deflectable portion 50 of the connector overbody 35 to overcome a bias provided by the material of the connector overbody 35, which otherwise maintains the switch 15 in an open circuit or off position and thereby the light 20 is not energized unless the overbody 35 is squeezed at the deflectable portion 50. The overbody 35 may be provided as a polymeric material, molded/sealed around the selected connection interface, encapsulating the switch 15 and LED circuit, inhibiting fouling and/or moisture contamination of the LED circuit.

Figure 5:
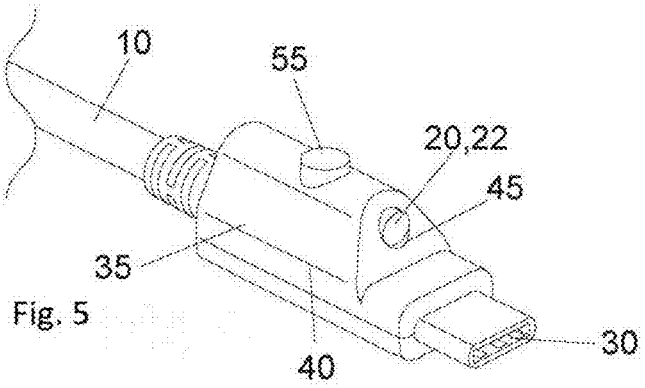
FIG. 5 is a schematic isometric view of a connection interface with a light for illuminating the connection area, demonstrating a momentary switch with an external button surface.

FIG. 5 demonstrates a connector overbody 35 with an external button surface 55 that activates the momentary switch 15 when depressed. The switch 15 may be momentary or include a retention function maintaining the light 20 in the energized/illuminated state until the connector overbody 35 is again depressed. The external button surface 55 may be a separate element movable within a cavity of the overbody 35, or a protrusion of the overbody 35 of the connector, useful as feedback of the location of the switch 15.

Figure 6:
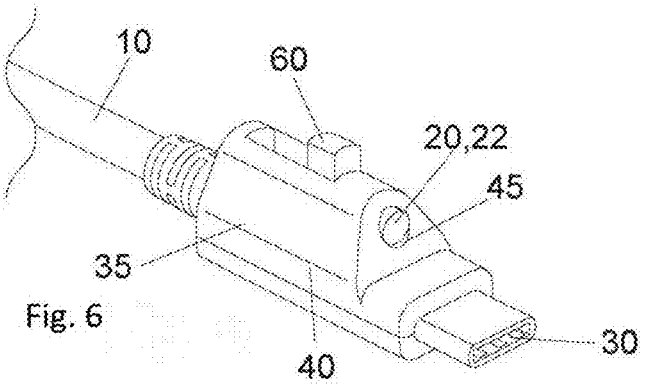
FIG. 6 is a schematic isometric view of a connection interface with a light for illuminating the connection area, demonstrating a slide switch.

FIG. 6 demonstrates a moveable switch 15 that activates when the switch handle 60 is moved from the off position to the on position. The switch 15 may be spring biased towards the off position or self retaining in the on and/or off position, enabling the light 20 to be turned on without requiring the user to maintain a constant pressure upon the switch 15 and/or overbody 35 of the connector.

Figure 7:
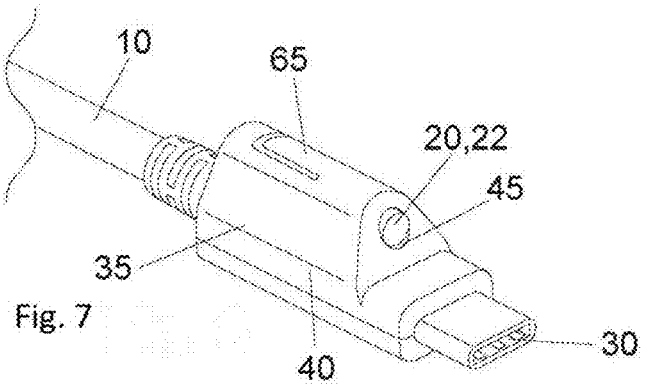
FIG. 7 is a schematic isometric view of a connection interface with a light for illuminating the connection area, demonstrating a momentary switch with a bias provided by the overbody.

FIG. 7 demonstrates a flush button activation embodiment wherein the overbody 35 may provide a bias to the off position of the switch wherein the user flexes an overbody lever portion 65 against the switch 15 to activate it and the bias provided by the overbody 35 then removes the activation when the pressure is removed from the overbody lever portion 65.

A mechanical switch 15 is preferred to a capacitive switch as a capacitive switch may be activated whenever the capacitive switch surface is touched or when the capacitive switch surface contacts other surfaces with suitable capacitive characteristics and/or may not be reliably actuated when the user fails to have suitable body capacitance, for example due to insulating coatings, a grounded environment and/or humidity pre-emptively inhibiting charging and/or dissipating any charge that may be present. Where a capacitive switch is applied to an interface cable, as the operator for a light or the like the capacitive switch may actuate by accident if accidentally shifted into contact with a suitable surface, turning on the light and disturbing those nearby.

As referenced herein, a mechanical switch is defined as a switch requiring physical movement of at least a portion of the switch to engage or disengage electrical continuity across the switch.

The several embodiments have been demonstrated with respect to the USB-C interface 30. Alternatively, one skilled in the art will appreciate that the connection interface may be any standard or proprietary connection interface, which also utilize CC power level negotiation data conductors.

In further embodiments the cable 10 may be applied with any of a range of interconnections opposite the illuminated connector interface end and/or with an illuminated connector interface at both ends of the cable. Further, the non-illuminated connection interface end of the cable may be provided with any desired interface and/or directly connected module, such as an automobile cigarette lighter adapter 70, for example as shown in FIG. 8 or a wall outlet adapter 75, for example as shown in FIG. 9.

To be compliant with the USB-C specification for use in both power and data transfer modes, several additional data/communication conductors extending end to end are present in the cable 10. Details of these conductors and their termination at the pins of the USB-C connection interface(s) at the cable ends (see FIG. 2) are available in the USB-C Technical Specification and as such are not discussed in further detail here. Where the cable 10 is utilized only for power transfer (such as embodiments of FIGS. 8 and 9 or where the cable 10 is provided with clear indicia indicating use for power transfer only) only three end to end conductors are required: Vbus, CC1 and ground. Thereby, a cost and cable diameter efficient USB-C power transfer cable 10 is enabled.

One skilled in the art will appreciate that the illuminated interface cable remains operable according to the USB-C Technical Specification and further provides a positive engagement characteristic for activating the illumination that is unlikely to be inadvertently activated by mere incidental contact with surrounding objects. Further, the circuit requirements for the illuminated interface cable enables addition of the illumination functionality with minimal additional cost and high reliability.

Table of Parts

10 cable
15 switch
20 light
22 light emitting diode
30 USB-C
32 pull down resistor
35 overbody
40 connector hand grip surface
45 aperture
50 deflectable portion
55 external button surface
60 switch handle
65 lever portion
70 automobile cigarette lighter adapter
75 wall outlet adapter
80 interface area
85 interface While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An illuminated power adapter, comprising;

a cable with a Universal Serial Bus type C (USB-C) connector interface on a first end; the USB-C connector interface including a CC pin coupled to a CC conductor of the cable;

a light and a mechanical switch connected in series between the CC conductor and a ground conductor of the cable;

the light and the mechanical switch coupled to the connector interface, the light oriented to illuminate an interconnection area of the connector interface.

2. The illuminated power adapter of claim 1, wherein the light is a light emitting diode.

3. The illuminated power adapter of claim 1, wherein the CC pin is a CC1 pin on a first side of the USB-C connector interface; and a CC2 pin on a second side of the USB-C connector interface is connected to a grounded pull down resistor at each of the first end and at a second end.

4. The illuminated power adapter of claim 1, wherein the cable has a USB-C connector interface on a second end.

5. The illuminated power adapter of claim 1, wherein the illuminated power adapter conforms to the Universal Serial Bus Revision 3.2 specification.

6. The illuminated power adapter of claim 1, wherein the CC pin is operative to designate a power level of a Vbus conductor of the cable.

7. The illuminated cable of claim 1, wherein the light and mechanical switch are encapsulated within a polymeric overbody of the connector interface.

8. The illuminated cable of claim 1, wherein the light is recessed within an aperture of the overbody, the aperture open to the interconnection area.

9. The illuminated cable of claim 7, wherein the overbody includes a deflectable portion of the overbody operable to actuate the mechanical switch.

10. The illuminated cable of claim 7, further including a switch handle coupled to the mechanical switch extends outward from the overbody.

11. The illuminated cable of claim 10, wherein the switch handle is spring biased towards an off position.

12. The illuminated cable of claim 11, wherein the switch handle is self retaining in an off and an on position.

13. The illuminated cable of claim 1, wherein with respect to conductors extending between the first end and a second end, the cable has only the CC conductor, the ground conductor and a Vbus conductor.

14. The illuminated cable of claim 1, further including a second USB-C connector interface at a second end, also including another CC pin coupled to the CC conductor of the cable;

another light and another mechanical switch connected in series between the CC conductor and the ground conductor of the cable;

the light and the mechanical switch of the second end coupled to the second USB-C connector interface, the light oriented to illuminate an interconnection area of the second USB-C connector interface.

15. The illuminated cable of claim 1, wherein the mechanical switch is biased toward an off position, momentarily actuatable by application of force to the mechanical switch.

16. The illuminated cable of claim 1, wherein one end of the cable is one of a wall outlet adapter and a cigarette lighter adapter.

17. A method for manufacturing an illuminated interface cable, comprising the steps of:

providing a cable with a Universal Serial Bus type C (USB-C) connector interface on a first end; the USB-C connector interface including a CC pin coupled to a CC conductor of the cable;

providing a light and a mechanical switch connected in series between the CC conductor and a ground conductor of the cable;

the light and the mechanical switch coupled to the connector interface, the light oriented to illuminate an interconnection area of the connector interface.

18. The method of claim 17, wherein the light and the mechanical switch are encapsulated in an overbody of the connector interface.

19. The method of claim 17, wherein each of the ends of the cable are provided with the connector interface, the light and the mechanical switch;

the lights oriented to illuminate the respective interconnection area of the respective connector interface.

* * * * *